US005642840A

United States Patent [19]

Abdi

[11] Patent Number: 5,642,840

[45] Date of Patent: Jul. 1, 1997

[54] GARMENT HANGER WITH IRREMOVABLE INFORMATION TABS

[76] Inventor: Abraham Abdi, 2738 N. Talbot, Orange, Calif. 92667

[21] Appl. No.: 528,261

[22] Filed: Sep. 14, 1995

[51] Int. Cl.[6] ..... A47G 25/14

[52] U.S. Cl. ..... 223/85; 40/322; 223/92

[58] Field of Search ..... 223/85, 92; 40/322

[56] References Cited

U.S. PATENT DOCUMENTS

| | | | |
|---|---|---|---|
| 5,096,101 | 3/1992 | Norman et al. | 223/85 |
| 5,199,608 | 4/1993 | Zuckerman | 223/85 |
| 5,238,159 | 8/1993 | Zuckerman | 40/322 |
| 5,305,933 | 4/1994 | Zuckerman | 223/85 |
| 5,469,995 | 11/1995 | Bredeweg et al. | 40/322 |

*Primary Examiner*—Bibhu Mohanty
*Attorney, Agent, or Firm*—G. Donald Weber, Jr.

[57] ABSTRACT

A garment hanger including a body having a hook and a tab holder for an information-bearing tab for displaying customer information. The tab holder is integrally formed as a part of the hanger and includes a slot therein. The information-bearing tab includes resilient fingers which engage the slot to substantially inhibit removal of the tab from the tab holder. Edge guards are formed on either side of the tab holder to prevent a person from obtaining access to the tab. Thus, once the tab is mounted on the tab holder, it cannot be removed without using a tool.

4 Claims, 1 Drawing Sheet

FIG. 1
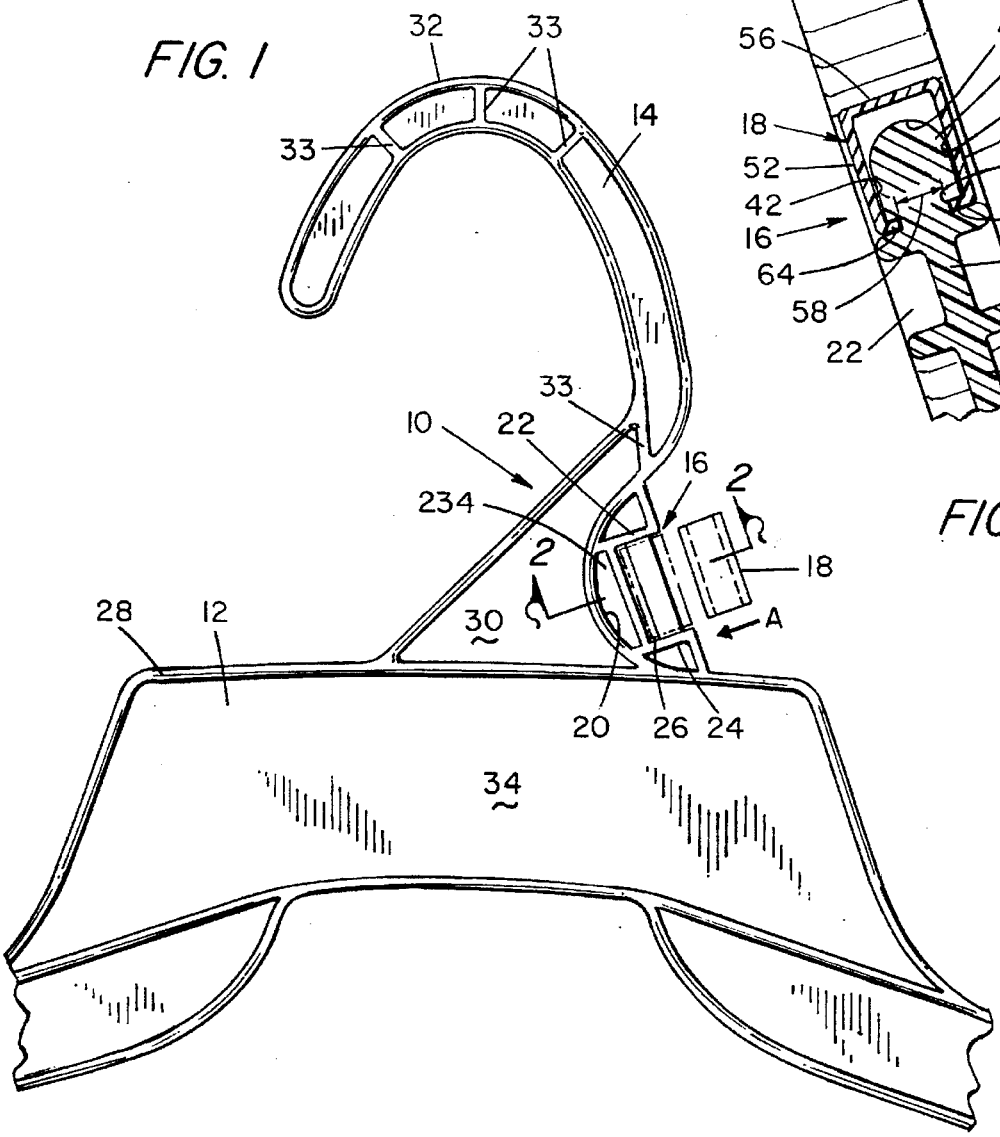
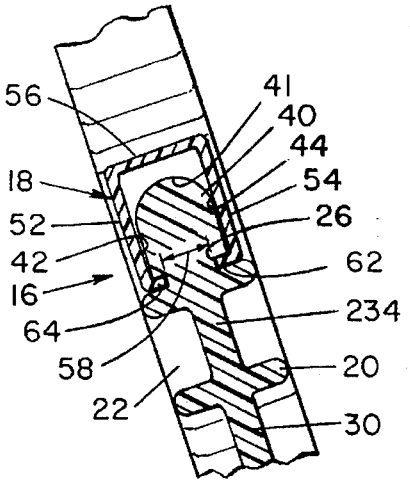
FIG. 2
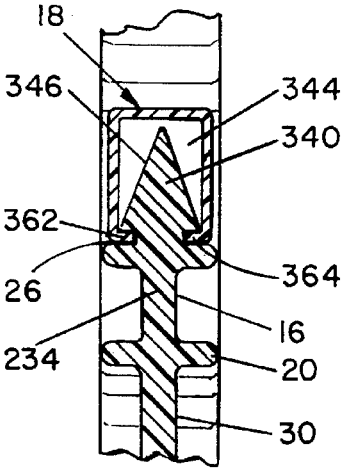
FIG. 3
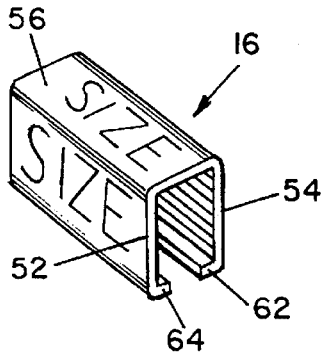
FIG. 4

GARMENT HANGER WITH IRREMOVABLE INFORMATION TABS

BACKGROUND OF THE INVENTION

1. Field of the Invention.

This invention is directed, in general, to a garment hanger with an information tab and, in particular, to a garment hanger with a locking information-bearing tab that essentially prevents removal of the tab from the hanger.

2. Prior Art.

It is desirable to provide garment hangers, display hangers or the like which can present information thereon to prospective customers. For example, a garment hangermay display information regarding the size or brand of clothing or other item supported on the hanger. Hangers of this type are often included with the garment item carried thereon. Once in the purchaser's home, the removable information tab may pose a danger to children who may swallow it.

One prior art device provided information by placing disks or tabs with printed information thereon over the hook of the hanger. Information tabs of this type are easily dislodged, removed, replaced or substituted.

Another prior art device provided information by using a tab with printed information thereon which was connected to the hanger by means of spring clips. Such information tabs also are easily dislodged, removed, replaced or substituted.

Other hanger and tab combinations of the prior art are described in U.S. Pat. No. 5,199,608 to Zuckerman and U.S. Pat. No. 5,096,101 to Norman et al. However, each of the devices described in these patents is highly complex and rather expensive. These devices include information tabs with internal fingers or the like which extend from the inner surfaces of the tab. The tab holders employ highly involved technical designs to interact with the tabs. These devices are, therefore, rather costly.

It is desirable to provide a hanger which holds an information tab securely thereon. It is also desirable to provide such a hanger with an information tab which is easily mounted by sales personnel or by an apparel manufacturer, yet relatively inexpensive and, therefore, suitable for distribution to purchasers of clothing.

SUMMARY OF THE INVENTION

The present invention includes a garment hanger comprising a body having a hook attached thereto. A tab holder for holding an information tab is formed between the body and the hook. The tab holder includes a slot and the information tab includes opposing end projections which are bent inwardly. The end projections are, thus, engaged with and captured in the slot in the tab holder to, effectively, prevent removal of the tab from the tab holder.

In a preferred embodiment, the tab holder includes edge guards having essentially the same width as the hanger body and hook neck. Parallel surfaces of the edge guards define a space therebetween to receive the information tab on the tab holder. The edge guards effectively cover the end projections of the tab engaged in the slot in the tab holder between the edge guards to prevent grasping the tab.

Thus, there is provided a hanger, typically, a garment hanger, which has an improved tab holder which cooperates with an improved information tab to essentially prevent removal of the tab from the hanger.

BRIEF DESCRIPTIONS OF THE DRAWINGS

FIG. 1 is a partial side, elevational, exploded view of one embodiment of the hanger of the instant invention and the interlocking information tab.

FIG. 2 is a partial cross-sectional view of one embodiment of the information tab mounted on the tab holder.

FIG. 3 is a partial cross-sectional view of another embodiment of the information tab mounted on tab holder.

FIG. 4 is a perspective view of the information tab.

DETAILED DESCRIPTION OF THE PREFERRED EMBODIMENT

Referring now to FIG. 1, there is shown a hanger 10. As used herein, the term hanger is generally understood to refer to hangers for clothing, but can relate to hangers for other items, as well. Hanger 10 can be planar or contoured. Hanger 10 may be constructed from a thermoplastic material using conventional injection molding techniques, though other techniques may be used. Hanger 10 may be formed of any suitable material, such as polystyrene, polypropylene, ABS or Nylon.

Hanger 10 includes a body 12, a hook 14 and a tab holder 16. Body 12 can take any conventional shape such as having shouders or the like. Likewise, hook 14 may take any convenient shape, such as the curved shape shown in FIG. 1. Alternatively, hook 14 may have a straight tail or neck. Hook 14 is, preferably, integrally formed with body 12.

Hanger body 12 is generally planar with a transverse reinforcing edge wall 28 thereby forming an I-beam-like construction extending around the periphery thereof. Similarly, hook member 14 is generally planar with a transverse reinforcing edge wall 32 around the periphery thereof. Hook member 14 has a base section 30 which joins shoulder 34 of hanger body 12. Reinforcing struts 33, similar to the reinforcing edge walls 28 and 32, can be provided, if desired.

Hanger 10 includes a tab holder 16 in the form of a web which extends between hanger body 12, typically at the shoulder 34 thereof, and hook member 14, typically adjacent the hook base section 30. (Of course, tab holder 16 may be positioned at other places on hanger 10, such as on the side of hook 14.)

Preferably, tab holder 16 extends between edge wall 28 of body 12 and edge wall 32 of hook 14. Tab holder 16 is adapted to receive and securely hold an information tab 18 (shown in dashed outline). Tab holder 16 is, preferably, integrally formed with body 12 and hook 14. Typically, tab holder 16 joins hook 14 (or the neck thereof) and body 12 along a single, common edge 20 of body 12 and hook 14. The tab holder 16 is generally planar with a slot 26 formed therein. The tab holder 16 is formed with any desired shape which facilitates the application of the information tab 18 thereto.

Information tab 18 is shown detached (shown in solid line) from the hanger 10 and, in particular, tab holder 16. As will be seen, information tab 18 is a, generally, C-shaped component which includes opposing ends which engage slot 26. Information tab 18, typically, may be used to display information, such as a garment size or brand. Of course, information tab 18 is compatible with several models of garment hangers varying in design and size.

In a preferred embodiment, two edge guards 22 and 24 are formed adjacent to (or integrally with) hook 14 and body 12, respectively. The edge guards 22 and 24 of tab holder 16 are formed at the edges of the tab holder 16, adjacent to the edge walls 32 and 28, respectively. As will be seen, the edge guards 22 and 24 are separated from each other by a distance only slightly larger than the width of the tab 18.

Referring now to FIG. 2, there is shown a partial cross-sectional view of tab holder 16 with information tab 18 engaged therewith. It is seen that the web 234 of tab holder 16 is approximately the same thickness as the body 12 or hook 14. The tab holder 16 includes an outer region 40 defined by sidewalls 42 and 44 as well as the outer edge 41 which is beveled or similarly shaped. A slot 26 is formed in the surfaces 42 and 43 of tab holder 16 adjacent the outer edge 41.

Information tab 18 is preferably formed from a resilient thermoplastic material of the type used in hanger 10 with a plastic extrusion process. Information tab 18 is generally C-shaped in cross-section and includes legs 52 and 54 extending from a top wall 56. Inwardly projecting fingers 62 and 64 are formed at the ends of the legs 52 and 54. The legs 52 and 54 are shown substantially parallel in this embodiment but other contours are contemplated. The fingers 62 and 64 at the ends of legs 52 and 54, respectively, are bent inwardly as depicted to define a gap 58. Typically, information, such as the size of a garment, is disposed on the top wall 56.

As shown in FIG. 1, information tab 18 is forced onto tab holder 16 in the direction of arrow A. Fingers 62 and 64 at the ends of legs 52 and 54 will be spread apart upon contact with beveled edge 41 of region 40.

Once fingers 62 and 64 pass beyond surfaces 42 and 44 of region 40, they move inwardly to return to their normal position due to the resilience of tab 18. The fingers 62 and 64 snap into and are lockingly engaged in slot 26 in the tab holder 16. This construction creates a tight locking fit which substantially prevents removal of the tab 18 from tab holder 16 when in place thereon.

The edge guards 22 and 24 (formed as part of tab holder 16 in the hanger) are wider than the tab holder 16 is thick. Thus, the surfaces of edge guards 22 and 24 extend beyond the surfaces of web 234. As seen in FIG. 2, the edge guard 22 extends beyond the outer surfaces of legs 52 and 54 of tab 18. Inasmuch as the side surfaces of the edge guards are in close proximity to the sides of information tab 18, the information tab 18 is secured to the web of tab holder 16 and, effectively, enclosed within the edge guards 22 and 24. Thus, the tab 18 is securely fastened and enclosed to thereby inhibit efforts to manually remove same.

Referring now to FIG. 3, there is shown a partial cross-sectional view of an alternative design of tab holder 16 with information tab 18 engaged therewith. It is seen that the leading edge region 340 of the tab holder 16 is, generally, triangular in cross-section. Region 340 is defined by sloping sidewalls 346 and 344 which terminate in slot 26 which is shown in FIGS. 1 and 2. Again, the information tab 18 is a C-shaped tab having a pair of substantially parallel side walls extending from end wall 56 and terminating in opposing fingers 362 and 364. The fingers 362 and 364 are shown engaged within slot 26 which is adapted to receive and secure the fingers of information tab 18.

Due to the inward construction of the fingers 362 and 364 of legs 52 and 54 of tab 18 which lock in the slot 26, a secure locking system is provided. The tab 18 is, essentially, locked on the tab holder 16 and is, therefore, tamper-proof.

The same (or similar) construction of the tab holder 18 could be provided on the side of hook 12 or on the edge of hanger body 12 to provide a secure locking of the tab.

Referring to FIG. 4, there is shown a perspective view of the tab 16 which includes the end wall 56. In this embodiment, a representative information label is depicted by the illustrative letters SIZE. Of course, other information can be placed on the tab by embossing, labelling or the like. The side walls 52 and 54, as well as the fingers 62 and 64, are also shown for convenience.

Thus, there is shown and described a unique design and concept of a garment hanger with an information tab which is not easily or readily removable without special tools. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A hanger including a removal resistant tab, comprising;

a body, a hook member connected to said body and forming an angle therebetween, a tab holder formed integrally with said hanger and disposed within said angle formed between said body and said hook member, said tab holder having a free edge spaced away from said hanger, a narrow slot formed in said tab holder adjacent to but spaced away from said free edge, said tab holder includes a thin wall within said slot, a tab adapted to be joined to said tab holder, said tab having a C-shape with a face member and two spaced apart, parallel legs extending perpendicularly from opposite edges of said face member, said spaced apart legs terminating in a foremost edge spaced away from said face member, said legs of said tab are biased toward each other, finger means disposed on the inner surfaces of each of said legs adjacent said foremost edge thereof for cooperatively engaging said narrow slot to thereby lock said tab to said tab holder, said finger means extend toward each other and substantially perpendicularly from the inner end of each of said spaced apart legs, said finger means on said legs of said tab abut against said thin wall when said information tab is mounted on said tab holder, the thickness of said face member, said legs and said finger means of said tab is equal and uniform, said slot having a width and height which are equivalent to the length and thickness, respectively, of said tab such that said finger means fit snugly within said slot, and edge guards formed on opposite sides of said tab holder, said edge guards spaced apart in order to be disposed adjacent to the sides of said tab without engaging said tab when said tab is joined to said tab holder in order to prevent a grasp on said tab sufficient to remove said tab from said tab holder.

2. The hanger recited in claim 1 wherein; said face member displays information thereon.

3. The hanger recited in claim 1 wherein, said free configuration has a rounded edge.

4. The hanger recited in claim 1 wherein, said free edge has a generally triangular cross-section configuration with sloping sidewalls and a sharp leading edge.

* * * * *